US006261019B1

(12) United States Patent
Furukawa

(10) Patent No.: US 6,261,019 B1
(45) Date of Patent: Jul. 17, 2001

(54) BALL POINT PEN

(75) Inventor: Kazuhiko Furukawa, Kanagawa (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/581,460

(22) PCT Filed: Oct. 29, 1998

(86) PCT No.: PCT/JP98/04888

§ 371 Date: Jun. 12, 2000

§ 102(e) Date: Jun. 12, 2000

(87) PCT Pub. No.: WO99/33670

PCT Pub. Date: Jul. 8, 1999

(30) Foreign Application Priority Data

Dec. 25, 1997 (JP) ..... 9-366300

(51) Int. Cl.[7] ..... D43K 5/02

(52) U.S. Cl. ..... 401/223; 401/224; 401/232

(58) Field of Search ..... 401/209, 223, 401/224, 225, 232, 242, 222, 208

(56) References Cited

U.S. PATENT DOCUMENTS 4,207,012 * 6/1980 Kuparinen ..... 401/242
4,556,336 * 12/1985 Sano et al. ..... 401/224
4,753,546 * 6/1988 Witz et al. ..... 401/242

FOREIGN PATENT DOCUMENTS 2-5991 2/1990 (JP) .
5-238186 9/1993 (JP) .
2552303 7/1997 (JP) .
9-202092 8/1997 (JP) .

* cited by examiner

*Primary Examiner*—David J. Walczak
(74) *Attorney, Agent, or Firm*—Darby & Darby

(57) ABSTRACT

In a free-ink type low-viscosity water-based ball point pen, the low viscosity water based ink 17 contains 40% or more of water as a main solvent and has a viscosity of 1.5 cps to 60 cps at a normal temperature. A collector 6 has a slender, slit-like ink groove 16 and an air vent groove 14. In a zone covering from a collector air-venting portion 15 to an outside air with which the collector air-venting portion 15 is communicated the collector 6 has a mouth piece 5 having provided therein the thin and elongate air vent groove 14. The maximum amount of ink stored in the collector 6 is made 15% or more of the capacity of an ink tank 9. The ink tank 9 is made detachable and has its main body formed of transparent or semi-transparent synthetic resin, the main body therefore enabling a residual amount of ink 17 to be visually recognizable from outside.

11 Claims, 4 Drawing Sheets

BALL POINT PEN

TECHNICAL FIELD

The present invention relates to an improvement of a free-ink type low-viscosity water-based ball point pen which falls under the category of a so-called "ball point pen" holding a ball constituting a writing portion at its pointed end and which is equipped with an ink tank for directly storing ink, a collector that is composed of a plurality of vane-like adjuster members for adjusting the interior pressure within the pen interior, the vane-like adjuster members being based on the use of a capillary action phenomenon, and a guide core for guiding the ink from an ink-accommodation tube to the ball constituting the writing portion.

BACKGROUND ART

An oil-based ball point pen that is conventionally known, for the purpose of preventing the movement of the ink, uses high-viscosity ink. Further, the oil-based ball point pen makes the ink-accommodation tube thin to thereby cause an increase in the capillary attraction force and thereby prevent the movement of the ink. However, as a result of this, there are the drawbacks such as heavy writing sensation, ink blobbing, uneven drawn lines, or low writing density. Also, there is known a so-called "a sliver type water-based ball point pen", in which a low-viscosity ink is impregnated into a fibrous sliver and this ink is guided up to a ball-pen tip via an ink-guiding center core. However, this type of ball point pen has the following drawbacks. Namely, the consumption of the ink is not known. The flow rate of the ink decreases with the progress of the writing, with the result that density of drawn lines become low. And, because of the necessity of drawing out the ink from the sliver, it is necessary to make the viscosity of the ink 2 to 3 cps and make the surface tension of the ink low. It results from this that the ink is likely to be blurred on the paper surface. Also, there is known a so-called "collector-type" of ink direct-storing type water-based ball point pen (hereinafter called "a collector ball point pen") to which in order to eliminate the above-described respective drawbacks there is applied a mechanism that has hitherto been used in a fountain pen, wherein an ink tank having ink directly stored therein is disposed rearward; and the replacement of air during the writing is adjusted via the internal pressure by means of a collector having a large number of vane-like grooves. However, in the collector ball point pen, the flow rate of the ink is as high as that of the water-based ball point pen. In addition, it is necessary to make the amount of ink loaded greater than that of the oil-based ball point pen. Therefore, in the collector ball point pen, it is practiced to make the diameter of the ink tank large and to store ink generally in volume of about 2 to 3 cc in the ink tank.

In the conventional collector ball point pen, when the fluctuation in the atmospheric pressure of the outside air occurs, the ink is moved into the collector to thereby adjust the internal pressure of the ball point pen. The ink is thereby prevented from leaking out from a tip of the pen. In the conventional collector ball point pen, in order to prevent the ink from being volatilized, it is generally practiced to provide a cap for hermetically closing the interior of the pen, by providing an undercut over the entire circumference of the inner surface of the cap so as to simultaneously seal the air hole and the pen tip and airtightly closing them. However, in this conventional collector ball point pen, there exists a drawback of a spilling over phenomenon that occurs due to so-called "pumping phenomenon". Namely, owing to putting on/off the cap, the internal pressure thereof changes and, as a result, the ink gradually gets more and more filled into the collector. And at last the amount of ink gets more than the limit up to which the collector can store the ink therein and the ink spills over from the air hole.

In order to eliminate the above-described drawbacks, there has hitherto been made a proposal in which a cap has the following cap mechanism. Namely, a spring 22 and a movable inner cap such as those illustrated in FIG. 1 are combined together. And it is arranged to hermetically seal the point assembly of the pen body by means of a seal surface 23 of the inner cap 21. In this cap mechanism, from the instant in which the seal surface 23 has been able to close the point assembly, even when any further axial stroke of the cap 12 occurs, no change occurs in the internal volume of the inner cap 21. In this cap mechanism, therefore, no change resultantly occurs in the internal pressure thereof and therefore no pumping phenomenon occurs. Also, in FIG. 1, a reference numeral 20 denotes an integrated barrel. Namely, FIG. 1 illustrates a disposable type ball point pen wherein a front barrel and a rear barrel and an ink tank are integrally formed together. However, this proposal had such drawbacks that the structure was complex and high in cost and also that the outside diameter of the cap 12 became large. It is to be noted that other portions in FIG. 1 than those described above are common to the portions shown in an embodiment as later described. And these portions will be described later.

Also, there is the drawback that the spilling over phenomenon occurs, as in the case of the preceding ball point pen examples as described, in the same mechanism when a decrease in pressure and an increase in pressure repeatedly occur as at the time of heating/cooling, within an airplane, under a high/low atmospheric pressure, at a high/low position in level, etc. In order to eliminate the above-described drawbacks, there have also been taken measures for solution to them, such as a measure to make further large the maximum amount of ink stored in the collector (to make large the diameter and the length thereof), a measure to make the ink tank small in size, etc. However, these measures are followed by such drawbacks that the size of the barrel of the ball point pen becomes large to cause degrading of outer appearance thereof, the content of ink becomes less with the result that the service life of the ball point pen becomes short to cause a deterioration of the cost performance, etc. Namely, even in the case of taking those measures, only products of a level having such drawbacks have hitherto been put to practical use.

The present invention has an object to provide mainly an improvement of a popular model of collector type water-based ball point pen. The present invention has satisfied, without obstructing performance of smooth writing during writing, a demand for reliably enhancing the following failure-preventing performance. The failure-preventing performance includes an ink leak-out preventing performance that, during transportation or at the time of putting on/off the cap, prevents the ink from leaking out due to the influence from an increase or decrease in the atmospheric pressure. The failure-preventing performance also includes a spilling over-preventing performance that prevents the spilling over of the ink in a case where the ball point pen has been kept displayed over a long period of time in a store, etc. By satisfying such demand, the present invention has an object to simultaneously settle subject matter such as eliminating such serious drawback as staining consumer's clothes, a demand for a collector type of ball point pen, which tends to become large in diameter, to have a slim outer appearance, and the cost performance that by replacing only the ink tank with another one it becomes possible to perform further writing, as well as to satisfy the writing performance as the conventional collector type ball point pen has.

DISCLOSURE OF THE INVENTION

In order to solve the above-described problems, the ball point pen of the present invention is equipped with a holder that retains at its tip a ball constituting a writing portion. The ball point pen is also equipped, at its point assembly having a ball seat for receiving the writing pressure at the time of writing, with a guide hole or a plurality of channel grooves enabling ensuring a channel extending from an ink tank to the ball constituting the writing portion. In the guide hole, there is inserted a center core that guides the ink from the ink tank to the ball through the use of a capillary force. Between a bottomed-cup-like ink tank and the point assembly there is provided a front barrel, in which there is disposed a collector comprising an air communication portion, a thin ink groove, and a plurality of vane-like groove portions, whereby having an internal-pressure-adjusting function of adjusting the internal pressure of the interior of the pen body by causing the ink to come into and go out from such vane-like groove portions.

The means for making the present invention effective is as follows. The maximum amount of ink stored in the collector is made 12% or more of the volume of the ink tank, preferably 15% or more. In a zone from the air communication portion of the collector to the outside there is fixed a mouth piece having provided therein a thin and elongated air channel with the use of a single piece of part or with a combined use of pieces of parts, thus to ensure air communication between the interior of the ball point pen and the exterior thereof in a state of being somewhat regulated. Further, a transparent or semi-transparent ink tank, in which the internal residual amount of ink can be visually recognizable is fixed detachably yet preventing the ink from being leaked out by forced insertion, and furthermore, even after the consumption of the whole ink, further writing is made possible by replacing the old ink tank with a new ink tank. The ball point pen of the present invention is made up into such a tank-replacing type of construction. The ink applied is a low-viscosity, water-based ink in which, in order to ensure the driability of a written/drawn line, a viscosity, the dissolvability (dispersiveness) of a coloring agent, etc., the ink contains as a main solvent 40% or more of water and, at a normal temperature (around 23 degrees), the viscosity thereof is from 1.5 to 60 cps. The ink may be ink that has been prepared by applying pseudo-plastic ink (called "gel ink"), wherein when it is in a stationary state, the viscosity is slightly high so as to prevent forward leaking or oozing out of ink from the tip, while when shear or movement occurs in the ink due to the writing, the viscosity decreases to thereby enable smooth writing to be performed.

As further means for making the present invention effective, there are the following invention-effectuating means. It may be so configured that at the rear of the front barrel for retaining the collector therein, a holding portion for having the ink tank forcedly inserted and held thereinto and a threaded portion for fixing by screwing thereinto the rear barrel located rearward are integrally formed. After having provided with such portions, within the cap there is fixed a tip-sealing rubber material member made of rubber or elastomer having elasticity for hermetically closing the writing ball and its neighboring portion located at a point assembly of the writing instrument. And air hole in side of the barrel is at all times released to the outside air without closing. Or it may be so configured that, which alkaline ink of PH 6 to 11 is contained, those parts including the ink tank, mouth piece, and holder that constitute 95% or more of the outer surface area of the outer surface portion contacting with the outside air and excluding the air hole are each constructed of a synthetic resin part, the material of that is among moisture-proof JIS-K7029 materials, has a water absorption rate (23° C.) of 0.2% or less, has anti-hydrolyzability, and has no ester bonds in its composition, a metallic part having water resistance, or an inorganic material part such as ceramic with non-water-permeability.

In view of the above-described means, aspects of the present invention are as follows.

Initially, a first aspect of the present invention provides a so-called "free-ink type low-viscosity" water-based ball point pen comprising: a holder for holding a ball constituting a writing portion at its tip, an ink tank for directly storing ink therein, a collector that adjusts the internal pressure of the pen interior and that is composed of a plurality of vane-like adjuster members utilizing a capillary action phenomenon, and a center core for guiding ink from an ink accommodation tube to the ball constituting the writing portion, characterized by satisfying all of the constructions under the following items (1) to (3):

(1) The ink is a low-viscosity water-based ink that contains 40% or more of water as a main solvent and the viscosity thereof is from 1.5 to 60 cps at normal temperature (about 23° C.);

(2) The collector has a slender, slit-like longitudinal groove for ink and an air-communication groove (or hole), while between the air communication groove of the collector and the outside air with which the air communication groove is communicated, there is provided a mouth piece having disposed of a slender, elongated air flow channel with the use of a single piece of part or a combined pieces of parts for suppressing the volatilization of the ink from the pen body; and, (3) The ink tank located behind the collector is detachably mounted wherein the maximum amount of ink accommodated in the collector is made 12% or more of the volume of the ink tank, while the ink tank has its main body formed of transparent or semi-transparent synthetic resin, enabling a residual amount of ink to be visually recognizable from outside.

Next, a second subject matter of the present invention provides a ball point pen as described in the first aspect, characterized in that , behind a front barrel retaining the collector therein, a holding portion for having the ink tank forcedly inserted thereinto and a threaded portion for fixing rear barrel located in rear screwed thereinto are integrally formed; subsequently, within the cap there is fixed a tip-sealing rubber material member made of rubber elastomer having elasticity for hermetically closing a writing ball and its neighboring portion located at a point assembly of the writing instrument; and an air hole in side of the barrel is at all times released to the outside air without closing.

Also, a third aspect of the present invention provides a ball point pen as described in the first aspect, characterized in that, in the water-based ball point pen directly storing neutral to alkaline ink of PH 6 to PH 11 therein, those parts including the ink tank, mouth piece, and holder that constitute 95% or more of the outer surface area of the outer surface portion contacting with the outside air and excluding the air hole are each constructed of a synthetic resin part, the material of that is among moisture-proof JIS-K7029 materials, has a water absorption rate (23° C.) of 0.2% or less, has anti-hydrolyzability, and has no ester bonds in its composition, a metallic part having water resistance, or an inorganic material part such as ceramic with non-water-permeability.

Further, a fourth aspect of the present invention provides a ball point pen as described in the second aspect, characterized in that, in the water-based ball point pen directly storing neutral to alkaline ink of PH 6 to PH 11 therein, those parts including the ink tank, mouth piece, and holder that constitute 95% or more of the outer surface area of the outer surface portion contacting with the outside air and excluding the air hole are each constructed of a synthetic resin part, the material of that is among moisture-proof JIS-K7029 materials, has a water absorption coefficient (23° C.) of 0.2% or less, has anti-hydrolyzability, and has no ester bonds in its composition, a metallic part having water resistance, or an inorganic material part such as ceramic with non-water-permeability.

BEST MODE FOR CARRYING OUT THE INVENTION

Figure 2:
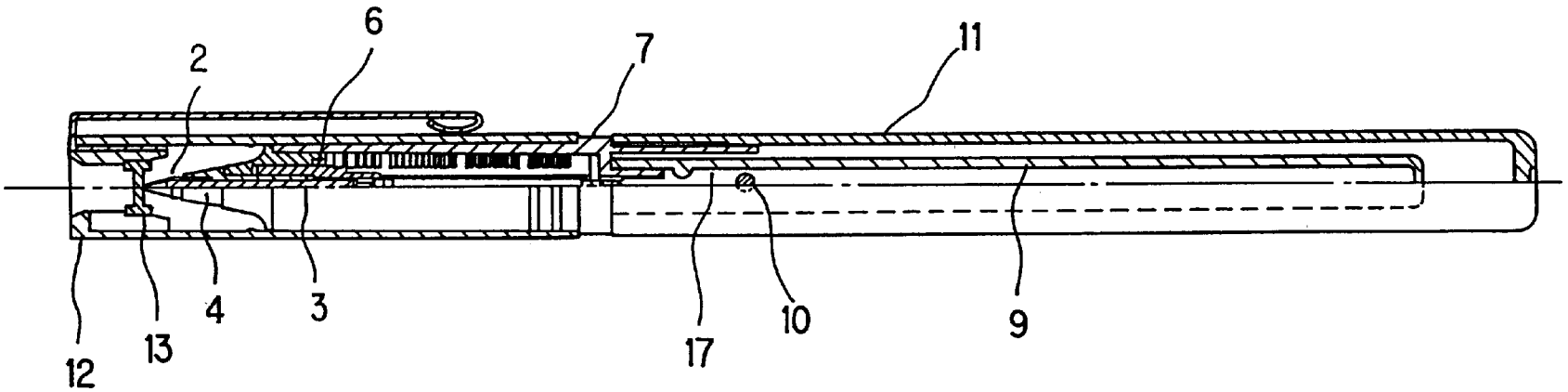
FIG. 2 is a longitudinal-sectional/partial exterior view showing the whole of a ball point pen according to an embodiment of the present invention.
Figure 3:
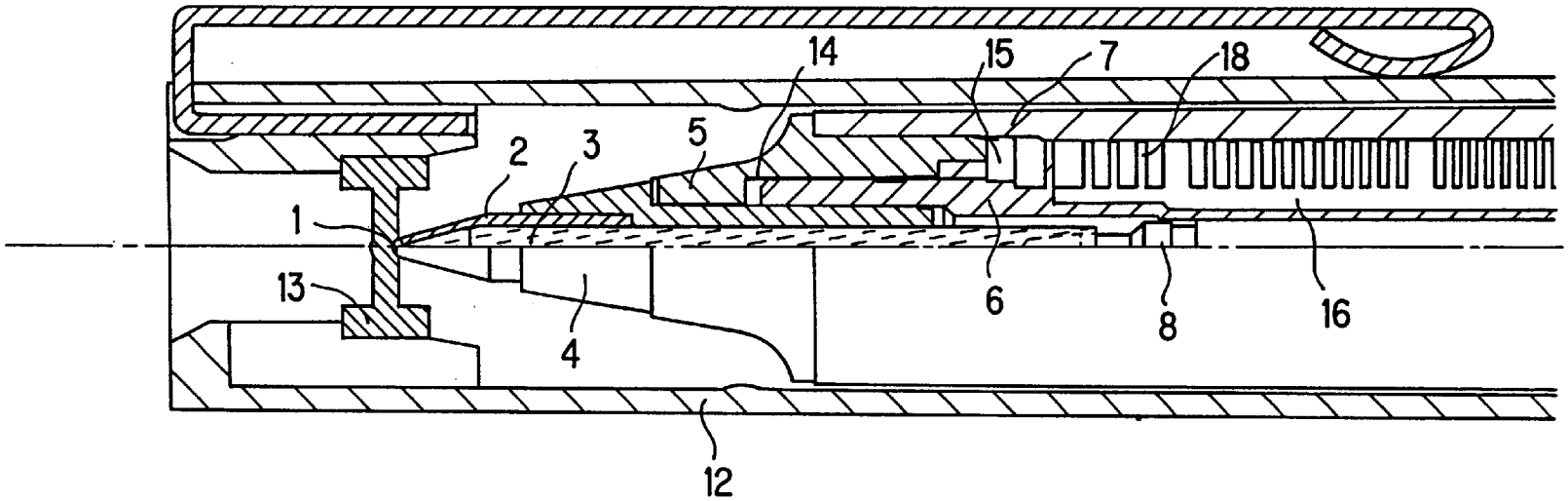
FIG. 3 is a longitudinal-sectional/partial exterior view showing a front side of the ball point pen according to the embodiment of the present invention; and, FIG. 4 is a longitudinal-sectional/partial exterior view showing a rear side of the ball point pen according to the embodiment of the present invention.
Figure 4:
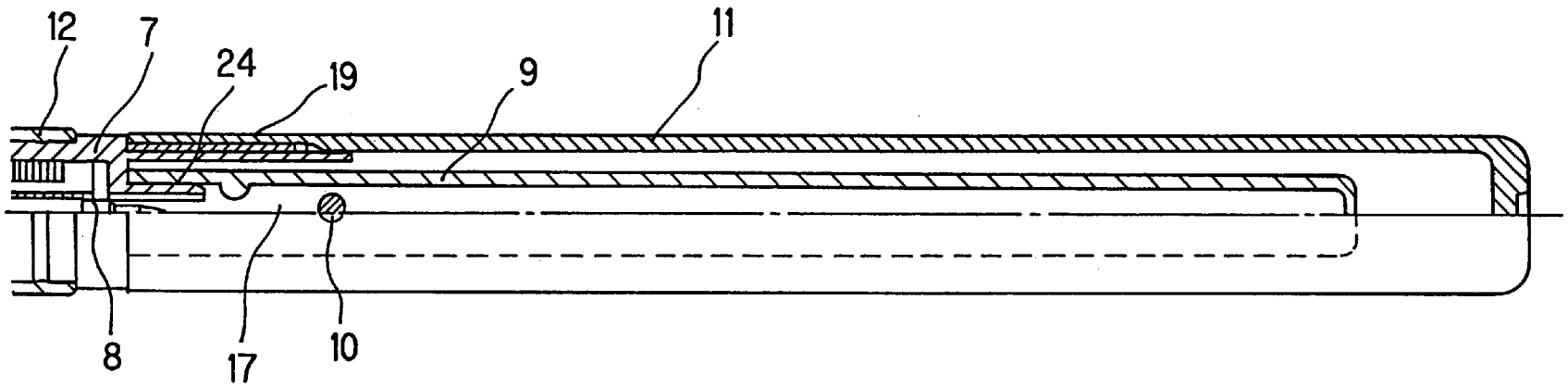

The illustrated embodiment will hereafter be explained in detail. FIGS. 2 to 4 illustrate an embodiment of the present invention. As illustrated in the drawings, a ball point pen of the present invention comprises a holder 2 at its point assembly with loosely fitted writing ball 1 thereinto so that the ball 1 may be rotatable and unable to be taken out, and further comprises a center core 3 in its interior, by means of which ink is guided from an ink tank 9 to the ball 1. The center core 3 may be an elongated one that extends up to the ink tank 9, or may be a combination of center core 3 made of a fiber bundle and a plastic core 8 that is a flower petal-like extruding tube having a capillary force in its interior. The ink tank 9 directly stores the ink 17 in its interior, which at a normal temperature possesses a relatively low viscosity of 1.5 to 60 cps and contains 40% or more of water as the base. The ink tank 9 is made of transparent or semi-transparent synthetic resin, which is equipped with an ink tank plug 10, and this ink tank 9 is forcedly inserted into a fixing portion 24 of a front barrel 7 and fixed thereto so that the ink does not leak out while being detachably disposed. As a coloring agent superior in water resistance and light resistance, there exist a pigment such as substantive dye and carbon black, a pseudo organic pigment such a dyed resin powder, etc. These coloring agents are each stable in a neutral to an alkaline medium, and in many cases, the ink used in a water-based ball point pen is likely to have PH value of about 6 to 11.

When a change in internal pressure relative to atmospheric pressure occurs either due to a decrease in volume of the ink by consumption at the time of writing or due to variation in the internal pressure itself, it happens that the ink may leak out from a pen tip portion where an ink flow channel for performing writing is ensured, or that air enters from the pen tip and as a result ink starving occurs. In order to prevent the occurrence of these drawbacks, the interior of the barrel and the outside are communicated with each other via a collector 6 comprising an ink groove 16, an air vent portion 15, and a plurality of vane-like grooves 18. When the pressure difference occurs between the outside air and the pen interior, the ink comes into and goes out of the vane-like grooves 18 of the collector 6, whereby effecting so as to increase or decrease the volume of the interior of the pen body, consequently balancing the external and the internal pressures.

The entire volume of the space, where the ink can be filled, of the vane-like grooves 18 of the collector 6 has been made 12% or more (preferably from 15% to 30%) of the volume of the ink tank 9. For example, under a decreased pressure inside an ordinary airplane, or under an increased vapor pressure of water in a case where the temperature rises from a room temperature to around 45° C., which is a maximum value of the atmospheric air temperature, the volume expansion of the air is approximately 12% or less. Therefore, in a case where performing the adjustment of the internal pressure, no problem generally occurs if a maximum change of the volume is absorbed approximately 12% by the collector 6. The increase in the volume that is applied to the interior at the time of replacing the ink tank 9 can be sufficiently absorbed by approximately 10% of internal-pressure-adjusting capability since the ink tank 9 for new replacement is substantially totally filled with the ink 17. Also, in the present invention, since the ink tank 9 has been made replaceable, it is possible to load the ink tank 9 by decreasing the volume of the tank to about 1 cc (the amount of ink is approximately 1 cc). Accordingly, it becomes possible to buy a cartridge that is more inexpensible than in the case of the conventional disposable type ball point pen whose ink tank volume is from 2 cc to 3 cc, resulting in elimination of cost-performance problem. Also, in a case where making the size of the collector 6 the same as that of the conventional collector, allowance becomes larger for the spilling over of the ink. As a result, even in a specific case where various conditions are combined together, it is possible to make the ball point pen a safe writing instrument having no drawback of spilling over. On the other hand, if maximum capacity of the collector 6 would be made the same as in the case of the conventional collector, the ball point pen could be made to have a thinner barrel than in the prior art, which enables to make the ball point pen of the present invention excellent in exterior appearance.

In an ordinary collector-type ball point pen, unless the ink has good wettability, the ink cannot smoothly come into or go out of the vane-like grooves 18. Therefore, the ball point pen is formed of, for example, ABS resin tending to have good affinity with water and high in water absorption rate and easily formable. As a result of this, the ink is more volatilized from the air hole and the tip and, consequently, the ball point pen cannot endure long-term storage in a state without a cap 12 capable of hermetically sealing by its protruded portion. Furthermore, even if the cap would be put on, there would be not only difficulty that the fitting of the cap is tight, loose, etc. but also if the cap 12 would be forgotten to put on, the ink should get dry, resulting in abnormality for writing. On this account, in the present invention, in a zone between the air vent portion 15 of the collector 6 and the outside air there is fixed by forced insertion the mouth piece 5 having provided therein the thin and elongate air vent groove 14 (having a sectional area of 0.01 to 0.5 $mm^2$ and a developed length of 5.0 mm or more, or preferably a sectional area of 0.02 to 0.1 $mm^2$ and a developed length of 10 mm to 40 mm) with the use of a single piece of part or combined use of other pieces of parts such as a joint 4. As a result of this, the internal vapor does not easily go outside the ball point pen, with the result that a change in the internal pressure can be dealt without any problem following. In addition, the water-based ink within the pen becomes unlikely to be volatilized and decreased. Therefore, the pen becomes cap-less and the seal using the cap 12 having a protruding portion becomes unnecessary. As a result, the performance becomes improved, the pen becomes easy to manufacture, and the cost-down becomes possible.

Figure 1:
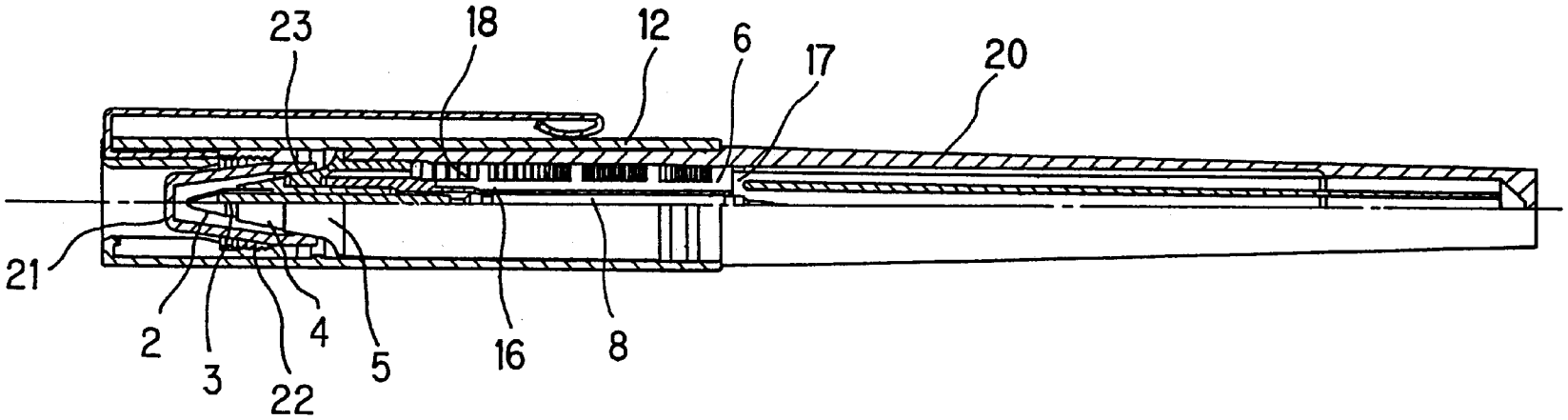
FIG. 1 PRIOR ART
FIG. 1 is a longitudinal-sectional/partial exterior view showing a ball point pen of a conventional example.

Also, as stated previously, in the conventional collector-type ball point pen, when sealing the tip by the protruding portion over the entire circumference of the cap 12, a change in the internal pressure of the cap 12 occurs. As a result of this, each time the cap is opened or closed, the ink 17 flows into or out of the vane-like grooves 18 of the collector 6 (the pumping phenomenon). As a result of this, for example, when the temperature rises, the pen ceases to have allowance for making adjustment of the internal pressure, resulting in the drawback of spilling over of the ink 17. For solving this, conventionally, a combined use of the spring and the movable inner cap, etc. such as those illustrated in FIG. 1, was proposed. However, as stated previously, such proposed arrangement had the drawback that it became complex in structure, high in cost, and large in diameter. In the present invention, it is not necessary to make a seal with the use of the cap 12, and therefore it is possible to prevent the occurrence of the pumping phenomenon completely.

Further, in the ball point pen of the present invention, unlike the conventional disposable type ball point pen, it becomes possible to continuously use the ball point pen merely by replacing the ink tank 9. In addition, the ball point pen of the present invention can exhibit completely the same excellent internal-pressure-adjusting performance as that of the conventional collector 6.

As the means for making the present invention further effective, on the front barrel 7 accommodating the collector 6, on rear side end of the pen interior, the fixing portion 24 of the ink tank 9 and the threaded portion 19 as a mounting portion of a rear barrel 11 are integrally formed. As a result of this, there is occurrence of neither leakage of the ink, nor difficulty that at the time of replacing the cartridge the parts become loose and resultantly disengaged, and furthermore, inexpensive manufacturing is expected. On the other hand, the cap is provided internally with a tip-sealing rubber material member 13 made of a rubber material member or elastomer having elasticity. Consequently, the tip of the pen is sealed, and accordingly a phenomenon that the tip gets slightly dried which causes ink starvation at the early stage of writing is prevented. Also, it is possible to prevent air from entering into the tip, due to an impact during transportation.

It has hitherto been vaguely known to form almost all of the parts contacting with the outside air by the use of moisture-proof synthetic resin or metal or inorganic material such as ceramic. Here, the present inventor carried out various experiments and as a result has obtained the following knowledge through the trial use of another example according to the present invention. That is to say, except for the air hole and a very small number of parts (in regard to 95% or more of the outer surface area), a plastic JIS standard K 7029 material, the water absorption rate, which makes a standard for determining on the moisture-proofness, of that was made 0.2% or less at a temperature of 23° C. in 24 hours. Consequently, it has been found that the water-volatilization-preventing effect is sufficient in the above-mentioned condition. However, the following knowledge was also obtained. Namely, there may be some cases that difficulty of degradation and cracks of the parts tends to occur when neutral to alkaline ink of PH 6 to 11 would be used. Also, even if the parts are not largely cracked, it happens that the parts may be hydrolyzed to cause occurrence of very small cracks. Then, although no leakage of ink may occur, the sealing characteristic of the parts may deteriorate, resulting that water components may be volatilized. As a result of close examination on the matter, it turned out that it is important that, in case of synthetic resin, no ester bonds should exist therein, and in case of metal, there should exists the moisture-proofness in alkaline water (no extreme rust, cracks or surface degradation), and furthermore, in case of inorganic material such as ceramic, there should exists no moisture-absorbing and water-permeating properties.

In practice, as the materials satisfying these requirements, polypropylene (PP: JIS of water absorption rate, 0.01%), polyethylene (hereinafter abbreviated as PE: 0.02%), polyolefins such as TPX (0.01%), PPS (0.02%), denatured PPE (0.07%), PS (from 0.1 to 0.2%), AS (0.2%), PEEK (0.1%), etc. Further, utilizing such materials as the base, it is possible to use a composite with inorganic materials such as glass and filler, or resin alloys (PS/PPE, PP/PPE, PP/rubber components), etc. Here, PET, PC, PBT, etc. has a water absorption rate of around 0.1% and therefore satisfy above requirements, nevertheless, since each of these materials possesses ester bonds, which causes low hydrolyzability. Meanwhile, POM, nylon, vinyl chloride, etc. has a high water absorption rate and therefore is inferior in terms of the moisture-proofness.

The experimental results for materials having differences in water absorption rate are shown below.

As major portion of a test piece, UB-150 manufactured by Mitsubishi Pencil K.K. was adopted. Meanwhile, ink tank and mouth piece were prepared as portions peculiar to the present invention. The following comparison experiments were carried out.

The ink PH was set as 8.5. Materials for front barrel and ink tank were each fixed to PP. The experiments were carried out without a cap, using various kinds of materials for the mouth piece and joint member of which their surface areas were comparatively small. (It was assumed that if the parts would have a larger surface area, the difference in results between the prior art and the invention would become even larger).

The evaluation items for the experiment are the amount of weight (mg) decreased due to the volatilization at a temperature of 50° C. for one month and writing performance. The writing performance was judged such that no problem in performance is marked as ○; slightly starved, nevertheless usable, is marked as Δ; and degraded performance is marked as X.

| | | |
|---|---|---|
| Example No. 1: polypropylene (PP): | 98 mg | ○ |
| Example No. 2: denatured polyphenylene ether (mPPE): | 120 mg | ○ |
| Example No. 3: polyphenylene sulfide (PPS): | 106 mg | ○ |
| Example No. 4: acrylonitrile, styrene (AS): | 135 mg | Δ |
| Example No. 5: machined stainless steel (SUS 430): | 87 mg | ○ |

-continued

| | | |
|---|---|---|
| Comparative Example No. 1: polyacetal (POM): | 168 mg | Δ to x |
| Comparative Example No. 2: polycarbonate (PC): Cracks occurred | 280 mg | x |
| Comparative Example No. 3: nylon (PA): | 350 mg | x |
| Comparative Example No. 4: machined aluminium (AL): Powdery rust observed on inner surface | 127 mg | x |

As apparent from the above Examples, the present invention exhibits the following excellent effects. Namely, the ball point pen of the present invention has been made to be a collector-type ball point pen with cartridge system wherein the ink tank is replaceable. Therefore, the ball point pen is slender and has good appearance. Also, by additionally using a inexpensive ink tank, the ball point pen can be made the one having excellent cost performance. Here, since the ball point pen of the present invention adopts the mechanism for suppressing the volatilization of ink, even if the cap is left removed for several days, it is possible to prevent the ink from solidifying. Also, regarding the ink, when a non-dry type prescription is applied by blending moisture-absorbing agent into the ink, it is possible to eliminate the use of the cap. In this case, since it becomes unnecessary to hermetically seal the pen tip by the protruding portion of the cap, the pumping phenomenon does not occur. Accordingly, the use of complex anti-pumping mechanism becomes unnecessary. In addition, from the viewpoint of the performance as well, it becomes able to make a full use of the ink storage mechanism of the collector. Here, if a significantly large amount of volatilization-retardant solvent would be prescribed to the ink, even with the conventional structure the ink would have the same level of resistance to volatilization as to the present invention. In this case, however, there comes up with the difficulty that a written line would not get dried quickly, and therefore the practical usability is sacrificed. On the other hands, in the present invention, it is not necessary to use such a special ink.

Conventionally, comparing size of the collector and the ink tank, the larger the ink tank is, the greater the air within the ink tank becomes expanded at the time of a rise of the temperature. As a result of this, when the volume within the ink tank gets more expanded than that corresponding to the volume-adjusting ability of the collector, the ink gets spilling over from the air hole. Meanwhile, in the present invention, because no problem exists in terms of the cost performance even when the volume of the ink tank is made small, it is possible to decrease the volume of the ink tank down to about 1 cc from the volume of the ink tank of about 3 cc of the ordinary disposable ball point pen. Furthermore, in the present invention, it is possible to use the ball point pen by replacing the ink tank about 5 times until the interior of the pen tip gets worn out and gets unusable. Therefore, the ball point pen of the present invention becomes about three times safer. In addition, the ball point pen of the present invention is as inexpensive as approximately half the price of a conventional ball point pen before the same service life is reached. Furthermore, if the pen tip is made of high hardness material or if the high wear resistance ink is adopted, the present invention becomes more effective.

If portions of outer-peripheral surface of the pen body which contacts with the outside air would configured by a material having moisture-proofness, the performance of the present invention becomes further effective. By selecting only the material having a water absorption rate of 0.2% or less and free from hydrolyzing, the present invention prevents the occurrence of the phenomenon that the ink gets volatilized and solidified. Especially, in that case, the present invention eliminates the problem such as the cracks, etc. that occur when alkaline ink has been used. Also, especially, by blending moisture-absorbing material in a small amount or adopting the ink slightly less volatilizable or solidifiable than conventional one, the present invention has such an effective performance that the ball point pen can be made to be a cap-less writing instrument.

INDUSTRIAL APPLICABILITY

As has been described above, according to the present invention, it is possible to make the ball point pen which is slender and has good appearance, and furthermore has excellent cost performance. Even when a cap will be left removed, it would be possible to prevent the ink from being solidified and degraded, consequently making the cap unnecessary. Furthermore, it would become possible to eliminate the necessity of hermetically sealing the pen tip by the protruding portion of the cap. Therefore, the pumping phenomenon would not occur, accordingly, the complex anti-pumping mechanism would become unnecessary. The ball point pen according to the present invention becomes safer and in addition becomes more inexpensive, until the same service life as an ordinary disposable-type ball point pen, wherein the ink gets spilled over from the air hole, is reached. If portions of outer-peripheral surface of the pen body which contacts with the outside air would be configured by a material having moisture-proofness, the performance of the present invention becomes further effective. And, in the present invention, it is also possible to make the ball point pen a cap-less writing instrument. As has been described above, according to the present invention, there is the effect that it is possible to provide a collector-type ball point pen with simple structure, easy to manufacture, inexpensive, and having good appearance.

What is claimed is:

1. A water-based ball point pen comprising:

a holder for holding a ball constituting a writing portion at its tip, an ink tank for directly storing ink therein, a collector that adjusts the internal pressure of the pen interior and that is composed of a plurality of vane-like adjuster members utilizing a capillary action phenomenon, and a center core for guiding ink from an ink accommodation tube to the ball constituting the writing portion, wherein the ink is a low-viscosity water-based ink that contains 40% or more of water as a main solvent and the viscosity thereof is from 1.5 to 60 cps at normal temperature, wherein the collector has a slender, slit-like longitudinal groove for ink and an air communication groove, while between the air communication groove of the collector and the outside air with which the air communication groove is communicated there is provided a mouth piece having disposed of a slender, elongated air flow channel with the use of one of a single piece of part and combined pieces of parts for suppressing the volatilization of the ink from the pen body, and wherein the ink tank located behind the collector is detachably mounted, wherein the maximum amount of ink accommodated in the collector is made 12% or more of the volume of the ink tank, while the ink tank has its main body formed of one of a transparent synthetic resin and a semi-transparent synthetic resin, enabling a residual amount of ink to be visually recognizable from outside.

2. A ball point pen according to claim 1, wherein behind a front barrel retaining the collector therein, a holding portion for having the ink tank forcedly inserted thereinto and a threaded portion for fixing a rear barrel located in rear screwed thereinto are integrally formed, subsequently, within a cap there is fixed a tip-sealing rubber material member made of one of a rubber and an elastomer and having elasticity for hermetically closing a writing ball and its neighboring portion located at a point assembly of the writing instrument, and the air communication groove disposed within the barrel is at all times in communication with the outside air without closing.

3. A ball point pen according to claim 2, wherein the water-based ball point pen directly storing neutral to alkaline ink of PH 6 to 11 therein, those parts including the ink tank, mouth piece, and holder that constitute 95% or more of an outer surface area of an outer surface portion contacting with the outside air and excluding the air communication groove are each constructed of a synthetic resin part, the material of that is among moisture-proof JIS-K7029 materials, has a water absorption rate of 0.2% or less, has anti-hydrolyzability, and has no ester bonds in its composition, and includes one of a metallic part having water resistance and an inorganic part having non-water permeability properties.

4. A ball point pen according to claim 1, wherein the water-based ball point pen directly storing neutral to alkaline ink of PH 6 to 11 therein, those parts including the ink tank, mouth piece, and holder that constitute 95% or more of an outer surface area of an outer surface portion contacting with the outside air and excluding the air communication groove are each constructed of a synthetic resin part, the material of that is among moisture-proof JIS-K7029 materials, has a water absorption rate of 0.2% or less, has anti-hydrolyzability, and has no ester bonds in its composition, and includes one of a metallic part having water resistance and an inorganic material part having non-water permeability properties.

5. A water-based ball point pen comprising:

a holder for holding a ball constituting a writing portion at its tip;

an ink tank for directly storing ink therein;

a collector for adjusting internal pressure of an interior of the pen, the collector including a plurality of vane-like adjuster members utilizing a capillary action phenomenon;

a center core for guiding ink from an ink accommodation tube to the ball constituting the writing portion; and wherein the ink is a low-viscosity water-based ink that contains 40% or more of water as a main solvent and the viscosity thereof is from 1.5 to 60 cps at normal temperature;

the collector having a slender, slit-like ink longitudinal groove for ink and an air communication groove, a mouth piece being provided between the air communication groove and outside air;

the maximum amount of ink accommodated in the collector being made 12% or more of a volume of the ink tank, while the ink tank has a main body formed of one of a transparent synthetic resin and a semi-transparent synthetic resin, enabling a residual amount of ink to be visually recognizable from outside; and a neutral to alkaline ink of PH 6 to 11 is stored in the ink tank, and wherein the ink tank, mouth piece and holder occupy at least 95% of an outer surface area of an outer surface portion of a whole outer surface of the pen which is in contact with outside air, excluding an area occupied by the air hole, each of the ink tank, mouth piece, and holder being constructed of a synthetic resin part formed of a material which has a water absorption rate of 0.2% or less, has anti-hydrozability, and is free of ester bonds in its composition and includes one of a metallic part having water resistance and an inorganic material having non-water permeability properties.

6. A ball point pen according to claim 5, further including:

a cap having a tip-sealing member disposed therein, the member being formed of one of a rubber and an elastomer, the member having elasticity for hermetically closing the writing ball and a neighboring portion located at a point assembly of the pen and the air communication groove disposed within the collector is at all times in communication with the outside air without closing.

7. A ball point pen according to claim 6, further including:

a front barrel retaining the collector therein, the front barrel having a holding portion and a threaded portion each integrally formed with the front barrel, the ink tank being forcedly inserted into the holding portion of the front barrel and the threaded portion fixedly receiving a rear barrel, the ink tank being located behind the collector and being detachably mounted to the front barrel, the mouth piece including a slender, elongated air flow channel for suppressing the volatilization of the ink from the pen.

8. A ball point pen according to claim 5, further including:

a front barrel retaining the collector therein, the front barrel having a holding portion and a threaded portion each integrally formed with the front barrel, the ink tank being forcedly inserted into the holding portion of the front barrel and the threaded portion fixedly receiving a rear barrel, the ink tank being located behind the collector and being detachably mounted to the front barrel, the mouth piece including a slender, elongated air flow channel for suppressing the volatilization of the ink from the pen.

9. A ball point pen according to claim 8, wherein the mouth piece is formed of one of a single part and combined parts.

10. A ball point pen according to claim 5, wherein the center core is formed of a fiber bundle.

11. A ball point pen according to claim 5, wherein the normal temperature is about 23° C.

* * * * *